United States Patent [19]

Scheffee

[11] Patent Number: 4,630,556

[45] Date of Patent: Dec. 23, 1986

[54] METHOD FOR BURNING COAL-LIQUID SLURRY FUELS AND APPARATUS THEREFOR

[75] Inventor: Robert S. Scheffee, Lorton, Va.

[73] Assignee: Atlantic Research Corporation, Alexandria, Va.

[21] Appl. No.: 349,450

[22] Filed: Feb. 17, 1982

[51] Int. Cl.[4] ..... F23D 1/00; F23G 7/04

[52] U.S. Cl. ..... 110/347; 110/106; 110/238; 110/262; 110/222; 241/93; 241/39

[58] Field of Search ..... 110/106, 238, 262, 347, 110/222, 263; 241/93, 39

[56] References Cited

U.S. PATENT DOCUMENTS

| | | | |
|---|---|---|---|
| 2,213,668 | 9/1940 | Dundas et al. | 110/222 |
| 2,716,002 | 8/1955 | Craig | 110/106 |
| 2,808,011 | 10/1957 | Miller et al. | 110/238 |
| 3,002,472 | 10/1961 | Miller | 110/106 |
| 3,229,650 | 1/1966 | Reichl | 110/347 |
| 3,229,651 | 1/1966 | Wasp | 110/347 |
| 3,833,943 | 9/1974 | Sturtevant | 110/238 |
| 3,996,026 | 12/1976 | Cole | 110/238 |
| 4,094,625 | 6/1978 | Wang et al. | 110/238 |
| 4,133,487 | 1/1979 | Lanier | 241/5 |
| 4,153,411 | 5/1979 | Isheim | 110/238 |
| 4,211,174 | 7/1980 | Martin et al. | 110/263 |
| 4,213,407 | 7/1980 | Headley | 110/238 |
| 4,249,471 | 10/1981 | Gunnerman | 110/106 |
| 4,310,299 | 1/1982 | Binasik et al. | 110/106 |
| 4,343,246 | 8/1982 | Jukkola et al. | 110/106 |

*Primary Examiner*—Henry C. Yuen

*Attorney, Agent, or Firm*—Martha L. Ross

[57] ABSTRACT

Process for preventing clogging of an atomizing device, which is used to feed a fluid coal-liquid slurry fuel into a combustion chamber in the form of a particulate spray, by continuously passing all of the slurry fuel through a comminuting means positioned upstream of the atomizing device in the slurry fuel passage connected to the atomizer, and apparatus therefor.

20 Claims, 3 Drawing Figures

Fig. 1

METHOD FOR BURNING COAL-LIQUID SLURRY FUELS AND APPARATUS THEREFOR

BACKGROUND

Because of the need to conserve oil resources, a great deal of interest and effort have been directed to the development of fuel slurries in which coal of appropriate particulate size replaces some of the oil, as in coal-oil and coal-oil-water slurries, or all of the oil, as in coal-water slurries, for industrial use such as utilities. As in the case of oil, such fuel slurries are fed into the fuel combustion chamber, e.g. furnace or boiler, through an atomizing device which breaks up the slurry fuel into a fine particulate spray. Such atomizing devices have small orifices that can become clogged by any excessively sized coal particles which may be present in the fuel, thereby interrupting the combustion process and requiring clearing of the atomizer.

This invention relates to coal-liquid slurries which have been fully processed for direct use as a fuel, as distinguished, for example, from a slurry designed primarily for long distance pipeline transport, which may require additional processing, such as change in coal concentration, coal particle sizes, additives to increase stability, etc., for final use as a fuel. The term "slurry fuel" or "fuel slurry" as employed in this specification and claims, is to be construed in accordance with the foregoing definition.

The fine coal particles in slurry fuels properly formulated for efficient combustion are within a particle size range which readily burns in the combustion chamber. Atomizing devices for spraying the slurry into the combustion chamber are generally designed with small orifices of adequate diameter to accomodate the largest particle sizes in the fuel slurry formulation. However, after final formulation of the fuel slurries, excessively-sized coal particles in the form of agglomerates may contaminate the slurry. These may be aggregates of dried slurry which have formed on storage tank or pipe walls, aggregates resulting from exposure to air drying by evaporation at the surface of stored fuel or during handling, or aggregates which may form within the slurry during extended storage periods. The slurries may also include some excessively sized primary particles which occur accidentally during formulation of the fuel slurry.

The object of this invention is to provide a means for eliminating excessively sized contaminant coal particles, in the form of agglomerates or accidental primary particles, which may be present in the slurry fuel prior to entry of the fuel into the slurry atomizer and, thereby to prevent costly clogging of the atomizing device.

SUMMARY OF THE INVENTION

The fluid fuel slurry comprises finely-divided coal dispersed in a liquid carrier, such as oil, a mixture of oil and water, or water. The coal particle sizes, for a combustion-efficient slurry, are sufficiently small to burn completely when introduced into the particular combustion device for which the fuel is designed. Such slurries are known to the art.

For efficient combustion the fuel slurry, as in the case of oil, is broken into a particulate spray by means of an atomizing device having a relatively small orifice when the fuel is injected into the combustion chamber. The specific diameter of the atomizer orifice is generally designed for passage of the coal particle sizes in the fuel slurry formulation. Excessively sized particles, such as the aforedescribed contaminant coal agglomerates or primary coal particles accidentally occuring during production of the fuel, can clog the atomizer orifice.

The invention eliminates this problem by positioning a comminuting device, such as a kinetic mill, upstream of the atomizer in the passage or duct feeding the fuel to the atomizer in such a way that all of the fuel slurry passes through the comminuting device prior to entry into the atomizer. The comminuting device must be capable of applying shear stresses sufficient to disintegrate excessively sized aggregates and primary particles. Preferably the device is not designed or operated to apply shear stresses of a magnitude to reduce substantially the properly sized particles of the fuel slurry. This can readily be accomplished with a suitable comminutor which is designed to deliver only the required shear stresses or which can be adjusted to deliver such stresses, as for example, by reducing applied shear rate. The shear stresses required can be determined by experimental evaluation of the given fuel slurry.

The comminutor employed must also be designed to permit continuous passage of the fuel slurry through it to the atomizer. Preferably the comminutor is positioned as close to the atomizer as is practically possible to minimize formation of potentially contaminating coal agglomerates on the walls of the fuel duct between the comminutor and the atomizer.

In carrying out the invention, the fuel slurry is pumped from a storage chamber into a passage or duct which carries the fuel to an atomizer capable of spraying the fuel into a combustion chamber. In the course of its flow through the duct to the atomizer all of the slurry passes continuously through the aforedescribed comminuting device.

The comminuting device provides the additional advantage of improving uniformity of dispersion of the coal particles in the liquid carrier where such action may be desirable for a particular slurry fuel.

The invention is especially useful for coal-water slurries which generally carry substantially higher coal loadings than slurries in which oil is the liquid carrier.

DRAWINGS

DETAILED DESCRIPTION

Figure 1:
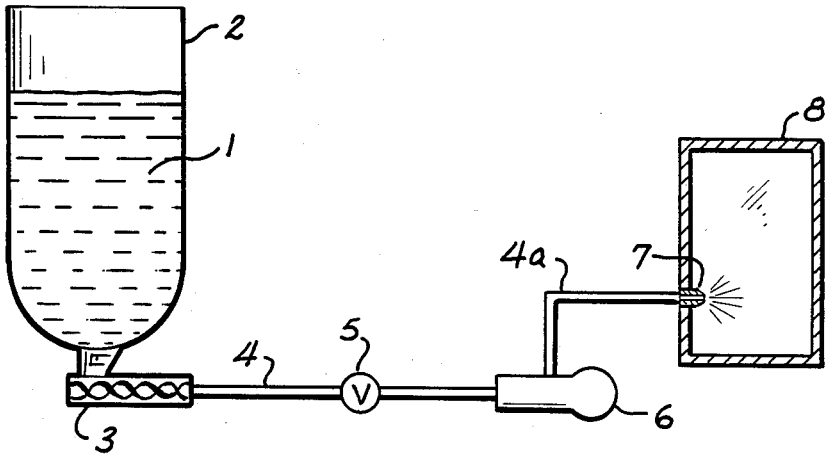
FIG. 1 is a schematic view in longitudinal section showing the apparatus of the invention.

As shown in FIG. 1, the coal-liquid slurry fuel 1, such as a coal-water slurry, is stored in storage tank 2. Positive displacement pump 3 pumps the slurry fuel into duct passage 4 equipped with valve 5 to comminuting device 6. All of the slurry passes through comminutor 6 into duct passage 4*a* and thence into atomizing device 7, which breaks up the slurry into a finely-divided spray and injects it into furnace 8, where the fuel is burned.

Figure 2:
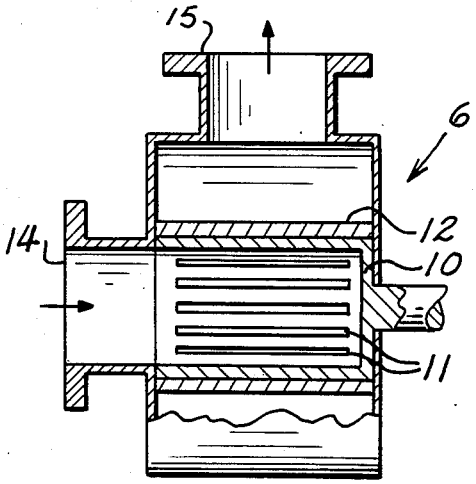
FIG. 2 is an expanded view of a comminuting device positioned upstream of the atomizer.
Figure 3:
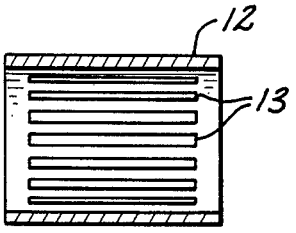
FIG. 3 is an expanded view showing the stator of FIG. 2.

FIG. 2 is an expanded view in longitudinal section of comminutor 6, which is generally referred to as a kinetic mill. It comprises a rotatable rotor 10 provided with a plurality of longitudinal slots 11 positioned within stationary stator 12 which is also provided with longitudinal slots 12 as shown in FIG. 3. Inlet 14 is a connected to duct 4 and outlet 15 is connected to duct 4*a* as shown in FIG. 1.

Although this invention has been described with reference to illustrative embodiments thereof, it will be apparent to those skilled in the art that the principles of this invention can be embodied in other forms but within the scope of the claims.

I claim:

1. A method for burning a coal/liquid fuel slurry which has been formulated to have the characteristics essential for use as a liquid fuel, including predetermined proper coal particle sizes having a maximum size smaller than that of the orifice of a given atomizing means and which, subsequent to said formulation may, at the point of use as a fuel, contain as contaminants coal particles, such as agglomerates, which are excessively sized relative to the orifice size of said atomizing means, comprising:

a. flowing said slurry fuel through a passage connected to said atomizing means and through said atomizing means into a combustion chamber;

b. positioning a comminuting means in said passage closely upstream of said atomizing means;

c. continuously passing all of said fuel in said passage through said comminuting means prior to passing into said atomizing means;

said comminuting means providing continuous passage of all said fuel therethrough and applying shear stresses sufficient to comminute said excessively-sized particles to a size smaller than said orifice.

2. The method of claim 1 wherein said comminuting means is designed or adjusted to be substantially incapable of substantially reducing particle sizes smaller than said orifice size.

3. The process of claim 2 wherein said comminuting means is a kinetic mill.

4. The method of claim 1 wherein said fuel is a coal-water slurry.

5. The method of claim 2 wherein said fuel is a coal-water slurry.

6. The method of claim 2 wherein said fuel is a coal-oil or a coal-oil-water slurry.

7. The method of claim 1 wherein said fuel is a coal-oil or a coal-oil-water slurry.

8. The process of claim 1 wherein said comminuting means is a kinetic mill.

9. Apparatus for burning a fluid coal-liquid slurry fuel which has been formulated to have the characteristics essential for use as a liquid fuel, including predetermined proper coal particle sizes having a maximum size smaller than that of the orifice of a given atomizing means and which, subsequent to said formulation may, at the point of use as a fuel, contain as contaminants coal particles, such as agglomerates, which are excessively sized relative to the orifice size of said atomizing means, comprising:

a. a combustion chamber;

b. atomizing means for said fuel opening into said chamber, said atomizing means having an orifice of given size to permit passage therethrough of said predetermined proper particle sizes;

c. a passage for said fuel connected to said atomizing means;

d. comminuting means positioned in said passage closely upstream of said atomizing means in such manner that all of said fuel flowing through said passage passes through said comminuting means;

said comminuting means providing continuous passage therethrough of all of said fuel and applying shear stresses sufficient to comminute said excessively sized particles to a size smaller than said orifice.

10. The apparatus of claim 9 wherein said comminuting means is designed or adjusted to be substantially incapable of substantially reducing particle sizes smaller than said orifice size.

11. The apparatus of claim 10 wherein said fuel is a coal-water slurry.

12. The apparatus of claim 11 wherein said comminuting means is a kinetic mill.

13. The apparatus of claim 10 wherein said fuel is a coal-oil or coal-oil-water slurry.

14. The apparatus of claim 13 wherein said comminuting means is a kinetic mill.

15. The apparatus of claim 10 wherein said comminuting means is a kinetic mill.

16. The apparatus of claim 9 wherein said fuel is a coal-water slurry.

17. The apparatus of claim 16 wherein said comminuting means is a kinetic mill.

18. The apparatus of claim 9 wherein said fuel is a coal-oil or coal-oil-water slurry.

19. The apparatus of claim 18 wherein said comminuting means is a kinetic mill.

20. The apparatus of claim 9 wherein said comminuting means is a kinetic mill.

* * * * *